United States Patent [19]

Berzina

[11] Patent Number: 4,899,970

[45] Date of Patent: Feb. 13, 1990

[54] PAINT CAN HANGER

[76] Inventor: James Berzina, 2812 Kingston Cir., Grand Island, Nebr. 68803

[21] Appl. No.: 291,264

[22] Filed: Dec. 28, 1988

[51] Int. Cl.[4] ..... E06C 7/14

[52] U.S. Cl. ..... 248/210; 248/311.2; 248/215; 182/129

[58] Field of Search ..... 248/210, 211, 238, 214, 248/215, 340, 311.2; 182/129, 121

[56] References Cited

U.S. PATENT DOCUMENTS

| | | | |
|---|---|---|---|
| 221,780 | 11/1879 | Clark | 182/121 |
| 1,047,251 | 12/1912 | Larson | 248/211 |
| 1,630,889 | 5/1927 | Clarke | 211/88 |
| 2,508,258 | 5/1950 | Heinrich | 248/210 |
| 2,948,349 | 8/1960 | Reddy | 182/121 |
| 3,052,442 | 7/1962 | Rankin, Jr. | 248/210 |
| 3,319,916 | 5/1967 | Malicoat | 248/210 |
| 3,642,240 | 2/1972 | Hershey | 248/210 |
| 3,809,351 | 5/1974 | Bravo et al. | 248/210 |
| 3,895,772 | 7/1975 | Ellingson | 248/210 |
| 3,998,416 | 12/1976 | Benolkin | 248/210 |
| 4,093,547 | 6/1978 | Sherman et al. | 248/215 |
| 4,403,368 | 9/1983 | Harper | 15/257 |
| 4,534,528 | 8/1985 | Rousseau | 248/210 |
| 4,676,468 | 6/1987 | Preston et al. | 248/238 |
| 4,787,586 | 11/1988 | Crain | 248/210 |

FOREIGN PATENT DOCUMENTS

| | | | |
|---|---|---|---|
| 516360 | 1/1953 | Belgium | 182/121 |
| 2046825 | 11/1980 | United Kingdom | 248/238 |

*Primary Examiner*—Alvin C. Chin-Shue

[57] ABSTRACT

A paint can hanger having a pair of outwardly extending paint can support arms, each having a top opening slot adjacent the free end thereof for pivotally receiving a bail socket of a paint can. The opposite ends of the support arms include open bottom hook means for placement onto either a step or rung of a ladder. Downwardly extending stabilizer legs engage the next adjacent lower step or rung to prevent downward pivotal movement of the hanger about the step or rung on which it is supported.

13 Claims, 2 Drawing Sheets

PAINT CAN HANGER

BACKGROUND OF THE INVENTION

The present invention is directed generally to a bracket for supporting a paint can on a ladder rung, step, or any other horizontally extended member, and more particularly to such a bracket having a pair of spaced apart support arms having the first ends adapted to pivotally receive the paint can bail sockets and opposite ends adapted for alternately engaging a ladder rung or step with at least one stabilizer leg protruding downwardly from the support arms for engagement with the next adjacent lower rung or step.

A problem with painting any elevated surface wherein the painter stands on a ladder is how to conveniently support the paint can for the painter. Domestic step ladders are generally provided with a pivotal paint can support tray adjacent the upper end thereof. Because only friction prevents the paint can from sliding off the tray, the paint can must be removed from the tray every time the ladder is moved and any accidental jolting of the ladder can cause the paint can to fall off the tray spilling paint over the work area. On extension ladders, the painter holds the paint can in one hand while painting with the other or precariously rests the paint can on the ladder rungs. In either event, the painter's hands are busy painting and preventing the paint can from falling amd may be unavailable for the most important task of holding onto the ladder to prevent the painter from falling off.

Whereas specialized paint can support brackets have been designed for support and adjustable movement on extension ladder siderails, such brackets support the paint can to the side of the ladder, thereby adversely affecting the balance of the ladder and most are usable only with custom designed ladders having special siderails. Such brackets are not universally suited for use on conventional ladders and none have been known to be commercially successful.

Accordingly, a primary object of the invention is to provide an improved paint can support bracket.

Another object is to provide such a bracket which is adapted to securely and pivotally support a paint can be engaging the bail sockets.

Another object is to provide such a bracket adapted for universal support on the rungs and steps of conventional step ladders and extension ladders.

Another object is to provide such a bracket which affords a balanced stable support of a paint can.

Another object is to provide such a bracket which is easily height adjustable on a ladder on which it is supported.

Another object is to provide such a bracket which supports a paint can for convenient access by a painter.

Finally, another object is to provide such a bracket which is simple and rugged in construction, economical to manufacture and efficient in operation.

SUMMARY OF THE INVENTION

The paint can support bracket of the present invention includes a pair of outwardly extending paint can support arms, each having a top opening slot adjacent the free end thereof for pivotally receiving a bail socket of a paint can such that a paint can is supportable on the arms for pivotal movement about an axis through the bail sockets. The opposite end of each support arm has an open bottom hook means for removable support on either a rung or step of a ladder. The support arms are connected together by a cross member in generally stationary relation to one another and at least one stabilizer leg extends downwardly from the support arms for abutment against the rung of a ladder which is next adjacent and lower than that on which the support arm hook means is supported to thereby stabilize the support arms against downward rotation about the rung engaged by the hook means. The pivotal support of the paint can prevents spillage of paint even when the ladder is moved and enables the paint can to remain vertical without regard to the angular position of the bracket.

The open bottom hook means is designed to alternately support the bracket on either the flat step of a step ladder or the generally circular rung of an extension ladder. In fact, the hook means accommodates support of the bracket on any horizontally extended member such as the cross supports on the back half of a step ladder or the top edge of a cherry picker bucket for elevating a man supported therein. More specifically, the open bottom hook means defines a stepped socket including a first wide shallow socket portion adapted to receive and engage a ladder step and a second narrower and deeper socket portion adapted to receive and engage a ladder rung.

With the paint can pivotally supported by the bail sockets the wire bail simply hangs from the socket against the side of the paint can and out of the way of a painter who, therefore, has unobstructed access to the open top of the paint can. Further convenience is afforded by a tool support tray extended across the top of the bracket and one or more side openings in the support arms which may be tapered downwardly for receiving and cinching a rag therein for ready access to a painter.

DESCRIPTION OF THE PREFERRED EMBODIMENT

Figure 1:
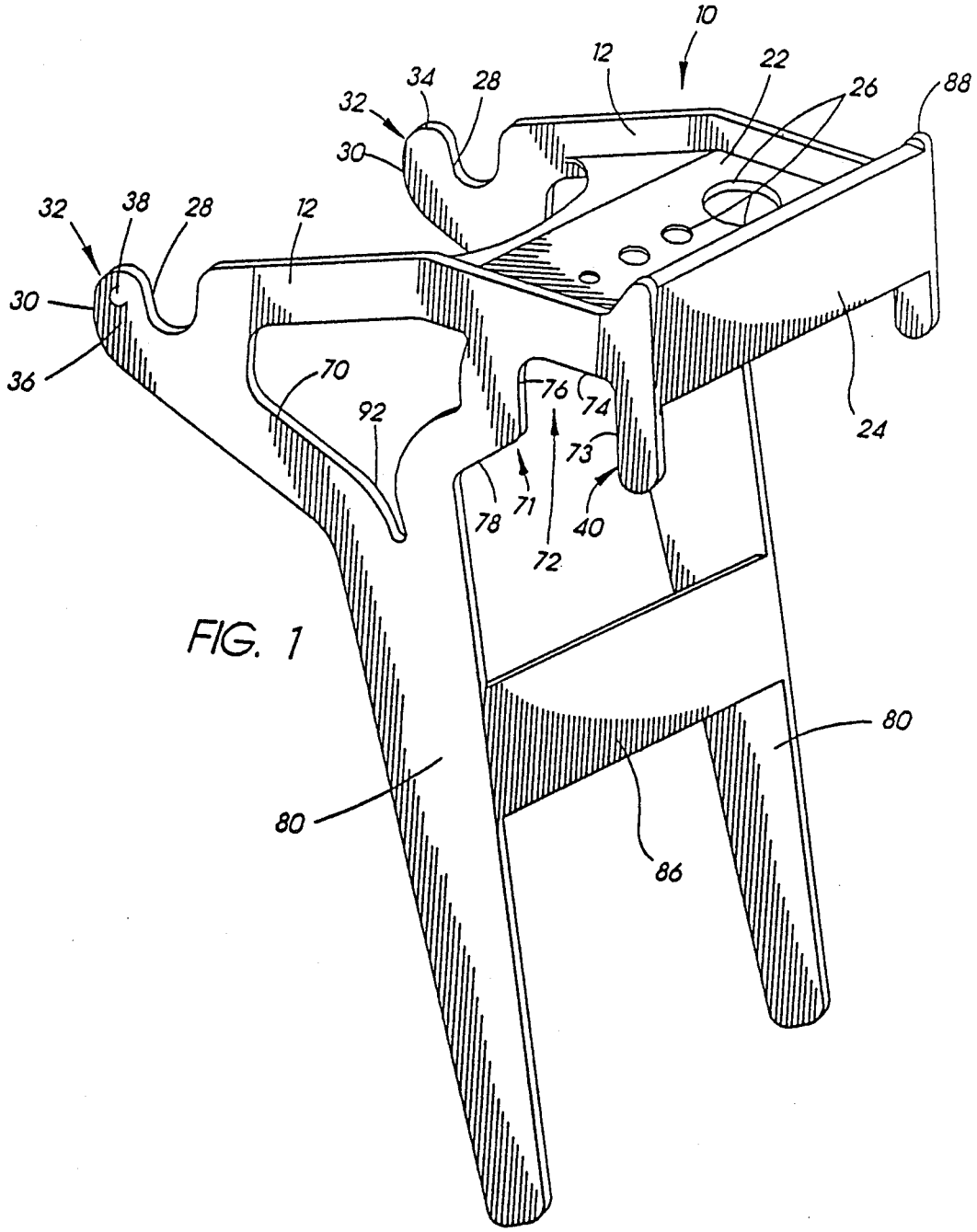
FIG. 1 is a perspective view of the paint can hanger of the invention.
Figure 2:
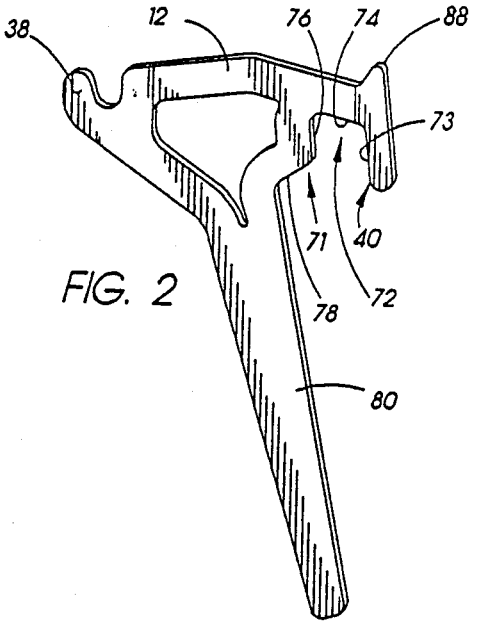
FIG. 2 is a perspective view of the support arm and stabilizer leg of one side of the hanger.
Figure 3:
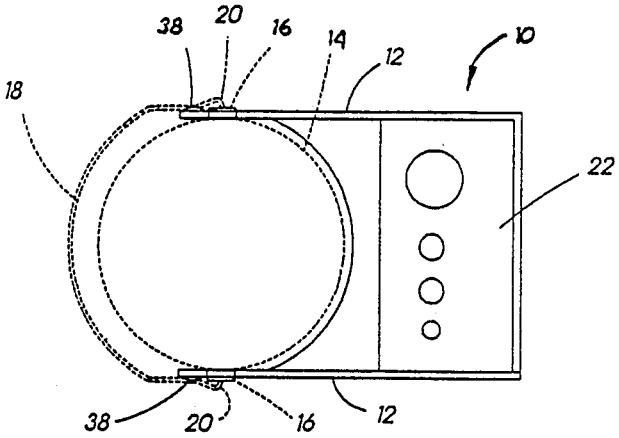
FIG. 3 is a top plan view of the hanger with a paint can supported thereon indicated in dotted lines.

The paint can hanger 10 of the present invention is illustrated in FIG. 1 as including a pair of outwardly extending paint can support arms 12 which are spaced apart by a distance for receiving a conventional one gallon paint can in close fit relation between them. Whereas smaller or larger brackets may be made to accommodate different size paint containers, the one gallow paint can is most commonly used and is, therefore, of primary concern. As shown in FIG. 3, the paint can 14 has a pair of circular bail sockets 16 on opposite sides thereof and a generally arcuate bail 18 with bent end portions 20 pivotally received within the bail sockets 16.

A cross member in the form of a tool support shelf 22 is connected to and extended between the support arms for securing them in generally stationary relation relative to one another. The support shelf 22 is preferably integrally formed with an upright cross plate 24 which is connected to and extended between the rearward ends of the support arms 12. The tool support shelf 22 may be provided with a plurality of holes 26 of varying sizes both for weight reduction and for supporting various tools such as a hammer, paint scrapper, screw driver and the like. A forwardly extended inclined portion 23 of shelf 24 has an arcuate edge in clearance relation from a paint can supported on the hanger so as to prevent the free ends 30 of support arms 12 from spreading apart while avoiding interference with pivotal movement of the paint can.

To pivotally support a paint can, each support arm 12 has a top opening slot 28 adjacent the free end 30 thereof. The bottom portion 32 of slot 28 is preferably semi-circular and of a diameter conforming to that of the outside diameter of the paint can bail socket for supporting the paint can for pivotal movement about an axis through the bail sockets 16. The open top of slots 28 enables a can to be easily placed into and removed from the support arms without obstruction.

The free ends of support arms 12 define a pair of arcuate horns 32 having interior surfaces 34 facing one another and opposite exterior surfaces 36. Each exterior surface 36 has a button or rounded protrusion 38 which frictionally engages the bail 18 of a paint can supported in slots 28 to maintain the bail below the top of the can out of the way of a painter. The bail can be easily snap fit over the buttons 38 upon lifting the bail to remove a paint can from the hanger 10.

The opposite or rearward end of each support arm 12 has an open bottom hook means 40 formed thereon for removable support of the support arms on the steps or rungs of a ladder.

Figure 4:
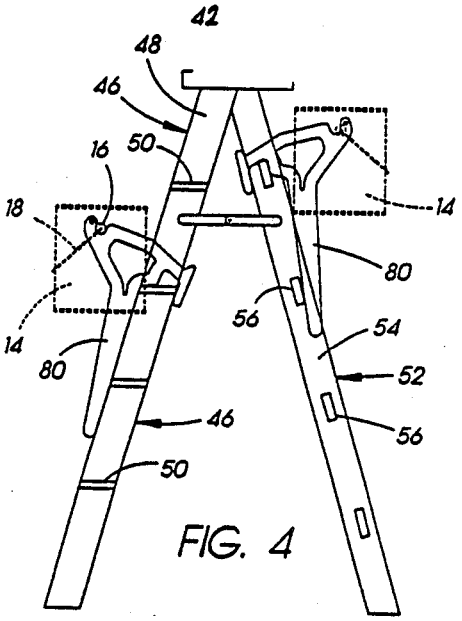
FIG. 4 is a side elevational view of a step ladder having a pair of paint can hangers of the invention supported thereon with paint cans indicated in dotted lines.
Figure 5:
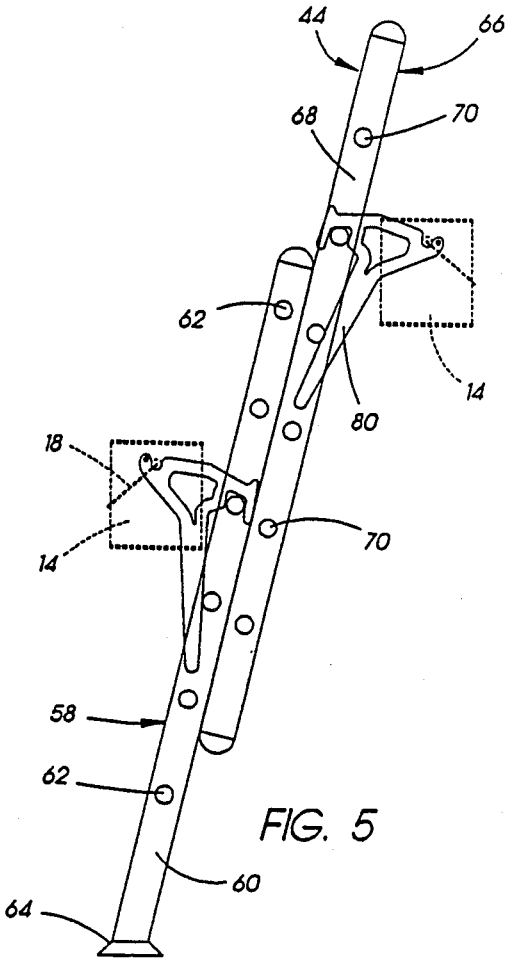
FIG. 5 is a side elevational view of an extension ladder having a pair of paint can hangers supported thereon in alternate positions with paint cans indicated in dotted lines.

The two most common types of ladders are the step ladder 42 of FIG. 4 and the extension ladder 44 of FIG. 5. Step ladder 42 includes a main ladder 46 having a pair of siderails 48 interconnected by a plurality of vertically spaced apart generally horizontally extended steps 50 of generally rectangular cross section. A pivotal stabilizer ladder 52 includes smaller siderails 54 inner interconnected by vertically spaced apart upright rectangular leg supports 56. Extension ladder 44 includes a base ladder 58 having a pair of opposite siderails 60 interconnected by vertically spaced apart substantially round rungs 62 with each side rail having a grounded engaging foot pad 64 on the bottom end thereof. A vertically adjustable upper ladder portion 66 likewise includes a pair of parallel spaced apart siderails 68 interconnected by vertically spaced apart circular rungs 70. The brackets for connecting upper ladder portion 66 to the base ladder 58 are conventional and are not included in the illustration of FIG. 5 for clarity.

The open bottom hook means 40 on the opposite end of each support arm 12 is adapted for use on any type of step, rung, leg support or the like. The open bottom hook means its formed in the shape of a stepped socket including a first wide shallow socket portion 71 adapted to receive and engage a ladder step 50 and a second narrower and deeper socket portion 72 adapted to receive and engage a ladder rung 62, leg support 56 or the like. More specifically, open bottom hook means 40, in the embodiment illustrated, includes a generally upright front wall 73 connected to a rearwardly extended top wall 74 which, in turn, is connected to a downwardly extending intermediate wall 76 of a shorter height than the front wall 72. The lower end of intermediate wall 76 is connected to a rearwardly extending step engagement wall 78, the rearward end of which is connected to the downwardly extending stabilizer leg 80.

Since the paint can is supported outwardly from the open bottom hook means, the hanger 10 tends to pivot downwardly about the hook means 40 to the extent of engagement of the stabilizer leg 80 with the next lower rung or step of a ladder. Referring to FIG. 4, the hanger 10 on main ladder 46 is readily supported on step 50 in contact with the step engaging front wall 72 and the step engagement wall 78. This is a useful position for supporting a paint can for a painter standing on the ground next to the ladder. When the ladder is used to support the painter, hanger 10 may be moved over to the stabilizer ladder 52 where the open bottom hook means 40 engages one of the rectangular leg support 56. Note that the rectangular leg support fits within the narrower and deeper socket portion 72 for engagement against top wall 74. In either position, the stabilizer leg 80 engages the next lower step 50 or rectangular leg support 56, as illustrated.

Likewise, on the extension ladder 44 illustrated in FIG. 5, hanger 10 may be supported either on the front side or back side of the extension ladder, as illustrated, and furthermore may be vertically adjusted onto any desired rung of the ladder, but for the bottom rungs since no lower rung is available for engagement by the stabilizer legs 80.

The angular relationship of the stabilizer legs 80 to support arms 12 is not critical to the invention but it is preferred that the portion of the stabilizer leg which engages a step ladder step be so positioned relative to the step engagement wall 78 that that wall is disposed substantially parallel to and in flush engagement with the step ladder step on which it is placed.

Note that the rearward end of each support arm includes a raised edge 88 which cooperates with the top edge of cross plate 24 to provide a raised surface which serves either to prevent a paint brush from falling off of the tool support shelf 22 or elevates the handle of a brush supported on the shelf 22 to allow paint to run toward the bottom of the brush and into the paint can 14. The exposed rearward surface of cross member 24 provides a flat space for displaying the seller's logo or advertisement.

Further weight reduction can be achieved by providing cut outs or holes 90 in the support arm 12. It is preferred that the holes taper downwardly as at 92 to form a slot for receiving and cinching a rag therein for ready access by a painter.

In operation, the paint can hanger 10 is readily placed onto any step or rung of a ladder that the painter has available. The pivotal support of the paint can assures that it will remain vertically disposed regardless of the angle of inclination of the hanger. Furthermore, the hanger engages the paint can at the bail sockets which are perhaps the strongest portion of the paint can. This also enables the wire bail 18 to be lowered out of the way. Since the bail is not used for support of the paint can, the problems of the bail wires slipping or pulling out of the bail sockets and resultant paint spills are avoided.

The downwardly extending stabilizer legs 80 are readily accessible for vertically adjusting the paint can hanger without removal of the paint can from the hanger. Since the hanger is supported centrally of the ladder on the steps or rungs, it does not upset the balance of the ladder and creates no advantage or disadvantage for either a right or left handed painter. It can be seen in FIG. 5 that an extension ladder can be raised or lowered without removal of the hanger from whichever ladder portion it is engaged upon.

Whereas the paint can hanger of the invention has been shown and described in connection with a preferred embodiment thereof, many modifications, substitutions and additions may be made which are within the intended broad scope of appended claims. For example, whereas the dual stabilizer legs are preferred, for stability, a single centrally situated stabilizer leg could be substituted. Likewise, whereas the preferred hanger is integrally molded as a single unit of a relatively rigid plastic material, it could be otherwise assembled from parts of other materials such as aluminum, wood, steel or the like.

Thus there has been shown and described a paint can hanger which accomplishes at least all of the stated objects.

I claim:

1. A bracket for adjustably supporting a paint can having an arcuate bail pivotally connected to bail sockets protruding from opposite sides of the can, on a ladder including a pair of spaced apart side rails and a plurality of rungs connected to and extended between said side rails in vertically spaced apart relation, said bracket comprising, a pair of outwardly extending paint can support arms having free ends adapted to receive a paint can in close fit relation there between, a cross member connected to and extending between said paint can support arms for securing said arms in generally stationary relation to one another, each support arm having a top opening slot adjacent the free end thereof for pivotally receiving a bail socket of a paint can whereby a paint can is supportable on said arms for pivotal movement about an axis through said bail sockets, open bottom hook means operatively associated with opposite ends of said support arms for removable support of said arms on a rung of a ladder, and at least one stabilizer leg connected to and extended downwardly from said support arms for abutment against the rung of a ladder which is next adjacent and lower than that on which said hook means are supported to thereby stabilize said support arms against downward rotation about said rung on which said hook means are supported.

2. The bracket of claim 1 wherein said open bottom hook means is adapted for alternately receiving either a ladder rung of generally circular cross section or a ladder step of generally horizontally extended rectangular cross section.

3. The bracket of claim 2 wherein said open bottom hook means defines a stepped socket including a first wide shallow socket portion adapted to receive and engage a ladder step and a second narrower and deeper socket portion adapted to receive and engage a ladder rung.

4. The bracket of claim 3 wherein said open bottom hook means includes a generally upright front wall adjacent a rearwardly extended top wall connected to a downwardly extending intermediate wall of a shorter height than said front wall and a rearwardly extending step engagement wall connected to a lower end of the intermediate wall and extended rearwardly therefrom whereby a ladder rung is adapted to be received within the channel defined by said front, top and intermediate walls and a ladder step is adapted to be engaged by said step engagement wall and at least one of said front wall and stabilizer leg.

5. The bracket of claim 1 wherein said top opening slot includes a generally semi-circular bottom portion of a diameter such that said bottom portion is substantially filled by a generally circular paint can bail socket received therein.

6. The bracket of claim 1 wherein the free ends of said support arms define a pair of arcuate horns having interior surfaces facing one another and opposite exterior faces, each exterior face having a protrusion thereon for engagement with the adjacent bail to restrict pivotal movement of the bail of a paint can supported on said arms.

7. The bracket of claim 1 further comprising a second stabilizer leg arranged parallel to and transversely spaced from said aforementioned stabilizer leg.

8. The bracket of claim 6 wherein each stabilizer leg is connected to and extended downwardly from a respective paint can support arm.

9. The bracket of claim 7 further comprising a cross member connected to and extended between said stabilizer legs at positions below said support arms.

10. The bracket of claim 8 wherein said bracket is integrally formed as a unitary piece.

11. The bracket of claim 7 further comprising a tool support surface connected to and extended between said support arms.

12. The bracket of claim 10 wherein said tool support surface as a plurality of holes therein both for weight reduction and for receiving and supporting tools therein.

13. The bracket of claim 8 wherein at least one of said support arms has a downwardly tapering opening therethrough for receiving and cinching a rag therein.

* * * * *